US005442385A

United States Patent [19]

Moon et al.

[11] Patent Number: 5,442,385

[45] Date of Patent: Aug. 15, 1995

[54] BIDIRECTIONAL BLACK AND COLOR PASS PRINT METHOD FOR INK-JET PRINTERS

[75] Inventors: Eva-Maria Moon, Washougal; Eric L. Ahlvin, Vancouver, both of Wash.

[73] Assignee: Hewlett-Packard Company, Palo Alto, Calif.

[21] Appl. No.: 954,835

[22] Filed: Sep. 30, 1992

[51] Int. Cl.[6] ..... B41J 2/21

[52] U.S. Cl. ..... 347/43

[58] Field of Search ..... 346/1.1, 46, 140 R, 346/49; 400/323.82; 358/502, 529; B41J 2/21; 395/104, 105, 109; 347/43, 41

[56] References Cited

U.S. PATENT DOCUMENTS

| | | | |
|---|---|---|---|
| 4,528,576 | 7/1985 | Koumura et al. | 346/140 R |
| 4,540,996 | 9/1985 | Saito | 346/140 R |
| 4,855,752 | 8/1989 | Bergstedt | 346/1.1 |
| 5,018,884 | 5/1991 | Hirano et al. | 346/140 R X |
| 5,160,942 | 11/1992 | Omata et al. | 346/46 X |

FOREIGN PATENT DOCUMENTS

| | | | |
|---|---|---|---|
| 378759 | 7/1990 | European Pat. Off. . | |
| 60-199662 | 10/1985 | Japan | 347/43 |
| 90/14957 | 12/1990 | WIPO . | |

*Primary Examiner*—Mark J. Reinhart
*Assistant Examiner*—Alrick Bobb

[57] ABSTRACT

Bidirectional interleaving of tri-color and black ink-jet pen print pass carriage retrace periods by the invention are utilized whenever possible for black printing. Preferably, printer controller logic used to determine next print direction monitors and records a most recent, or last, black print direction indicium such as a flag stored in memory. If certain predetermined last black print direction criteria are met, the next black print pass is performed in the opposite direction from that of the most recent color print pass, thereby increasing printer throughput. In accordance with the invention, typical tricolor and black printed swaths require up to three color print passes, one black print pass during retrace and only two non-printing retraces, thereby saving time and motion that otherwise would be wasted performing two additional, non-printing retraces.

12 Claims, No Drawings

BIDIRECTIONAL BLACK AND COLOR PASS PRINT METHOD FOR INK-JET PRINTERS

TECHNICAL FIELD

The present invention relates generally to improving the throughput of an ink-jet printer. More particularly, the invention concerns a method that provides bidirectionally interleaved black and color ink printhead passes, or black printing during color print retrace, which avoids wasted motion and increases printer throughput.

BACKGROUND ART

With uni-directional printing, as is conventional in single-pen ink-jet printers, a first print pass of the printhead carriage would proceed from the left to the right, and the carriage would retrace, or return without printing, to the left to the start of a next print pass. Another print pass then would print from the left to the right, and the carriage would retrace to the left to the start of yet another print pass. If such printing method were used in two-pen ink-jet printers, a first color pass, followed by a non-printing retrace, typically followed by a black pass, followed typically by second and third color passes would be required. Thus, a typical printable swath involving tri-color and black ink deposition would take three color print passes, one black print pass and four (non-printing) retraces. Much wasted motion would inhere in such tri-color and black ink-jet printing.

The advent of low-cost two-pen (one black and one tri-color) ink-jet printers thus poses both challenges and problems regarding bidirectional printing. One such bidirectional printing system is described in U.S. Pat. No. 5,044,796, entitled "Bidirectional Printing Method in Accordance with Vertical Breaks" issued Sep. 3, 1991 to Lund, which is subject to common ownership herewith. The disclosure of that patent is incorporated herein by this reference. Special concerns for monochromatic, e.g. black, and tri-color, e.g. cyan, magenta and yellow, print quality and black-to-color liquid ink bleeding phenomena must be addressed in order to maintain high overall print quality. At the same time, it is always desired to increase printer throughput, or at least to maintain the high throughput standards of previous single-pen ink-jet printers. While primitive or primary color blending is unpredictable, as it is largely user- and use-specific, monochrome printing is relatively predictable and thus is more controllable to the potential advantage of many users in varied applications.

DISCLOSURE OF THE INVENTION

The invented method bidirectionally interleaves color and black printing, thereby increasing ink-jet printer throughput. It does so by utilizing carriage color print retrace periods for black printing. The involved printer controller logic that determines next print direction by the invented method monitors and records a last black print direction flag and a last color print direction flag. Assuming that certain predetermined last black print direction rules, or criteria, are met, the next black print pass is performed in the opposite direction from that of the most recent color print pass. Preferably herein, color print passes are from left to right and black print passes are from right to left, although of course these directions may be reversed. By the invented method, typical tri-color and black printed swaths require only three color print passes, one black print pass and two retraces, thereby significantly improving ink-jet printer throughput and relieving stress on carriage drive components over an extended life of the printer. Of course, it will be appreciated that the invented method and improvement would be equally applicable to two-pen ink-jet printers having a black pen and a single-color pen.

These and additional objects and advantages of the present invention will be more readily understood after a consideration of the detailed description of the preferred method.

DETAILED DESCRIPTION OF THE PREFERRED METHOD AND BEST MODE OF CARRYING OUT THE INVENTION

Those of skill in the art will appreciate that the invented method and the improvement it represents may be carried out by the execution of firmware within a non-volatile read-only memory (ROM) device that may form a part of the printer's controller. Skilled persons also will appreciate that the invented method and the invented improvement, within the spirit and scope of the invention, may take the form of a hardware controller implemented in combinatorial and/or sequential logic devices. Those skilled in the art will appreciate that what will be referred to herein as "to-be-printed" black raster data may be buffered in any suitable memory device also connected with the printer's controller, as is conventional. Straightforwardly, then, the invented method and improvement preferably are implemented by suitable programming of a microprocessor to perform the required steps to be described.

As an aid to understanding the invention, it will be appreciated that, as used herein, black swath refers generally to a printable pattern of black ink dots deposited during a single pass of the ink-jet printer's printhead, i.e. a single-pass print image of predetermined height defined by the firing of one or more ink jets of the black ink pen. Similarly, color swath refers generally to such a printable pattern of color ink dots. Thus, black and color swaths may have virtually any pixel height per swath (corresponding to a number of fired ink jet orifices of the respective pen), e.g. of at least one pixel, and as between them black and color swaths may have different pixel heights, e.g. the black swath may have three times the pixel height of any color swath. Black and color swath direction, as used herein, refers to the direction of the printhead carriage during the deposition of such ink dots. Black and color swath printing refers generally to the printing, or ink dot deposition, of a black and color swath, respectively.

The invented ink-jet printing method is for color and black ink printing with a printhead carriage that mounts a color and a black pen. The invented method involving bidirectional black/color printing is made available as an option selectable by the printer's user. When invoked, the method includes 1) printing black raster data and storing an indicium of a first black direction of carriage movement during such printing; 2) printing color raster data with the carriage moving in a first color direction; 3) analyzing to-be-printed black raster data to predetermine whether the same are printable during a return pass of the carriage in a direction opposite that of the first color direction, with such predetermination being based at least in part upon stored indicia; and, if the to-be-printed black raster data are printable in such opposite direction, then 4) printing the to-be-printed black raster data in the first black direction.

The advantages of the invented method are evident. By printing black rasters, or printhead-height swaths, in the reverse direction of, and on the return pass of, the carriage following a color raster print, much of the carriage movement overhead, and attendant wasted motion, is eliminated. Importantly, however, the next to-be-printed black raster data must be analyzed to ensure generally that same-direction printing of successive black swaths results. Otherwise, slight carriage time placement differences between left-to-right and right-to-left carriage motion may produce unacceptable visible print quality deficiencies. For example, a continuous vertical black line or pattern on a page may appear alternately to step left and right at the frequency of the successive bidirectional carriage passes. In an extreme case, such a vertical black line or pattern may appear broken, or alternately offset left and right to the extent that discontinuities appear because of successive, alternate direction-printed horizontal dot placement having, for example, a several pixel or dot misalignment.

Preferably, the analyzing step includes determining whether the precedingly printed black raster data and the to-be-printed black raster data meet predefined black dot relative position criteria, with such criteria preferably including black dot relative horizontal position criteria, e.g. criteria determinative of whether a reverse-direction black swath defined by to-be-printed raster data might reduce print quality. Such criteria preferably include black dot relative horizontal position, e.g. relative horizontal alignment, criteria, and black dot relative vertical proximity, e.g. adjacency, criteria. The two criteria together avoid vertically continuous (uninterrupted) black lines defined by successive black swaths that if printed bidirectionally would be of low quality. In other words, black swath printing during color pass retrace is avoided if such could cause border black dots between corresponding recently printed and to-be-printed black swaths visibly to jag or otherwise deviate from the intended continuity and collinearity characteristics. It will be appreciated that, whether stated positively, as including a given condition, or whether stated negatively, as excluding a given condition, such criteria broadly stated are the basis on which such black print direction decisions are made.

Thus, it is preferable that such vertical adjacency criteria include continuity criteria so that it is determined whether such a jag would be visible, as it frequently is permissible to print black bidirectionally if there is vertical continuity required between adjacent black rasters. Such vertical continuity and horizontal alignment criteria clearly are inherently subjective, as is any print quality judgement. Presently, it is believed that any visible horizontal misalignment between adjacent black dots in a continuous vertical printed line is unacceptable, but that slight—e.g. no more than a few pixels' or printed dots' width—horizontal misalignment between black dots that are not vertically adjacent one another (forming a vertical gap or space therebetween) is acceptable.

Accordingly, while bidirectional printing of consecutive black swaths is avoided if it is determined that immediately adjacent black pixels on the borders of successive print swaths are in the same horizontal position in the black rasters, nevertheless bidirectional printing of consecutive black swaths is used, to great throughput advantage, if it is determined that two to four or more pixels separate such adjacent border pixels, i.e. the black dots represented thereby will be vertically separated on the printed page by a white, or unprinted, space of at least two to four pixels' height. Importantly, unidirectional printing of successive black swaths typically eliminates the visible horizontal alignment problems exhibited during bidirectional printing thereof.

It will be appreciated that any suitable memory device may be used to store the indicia, which may be singular, e.g. a single binary bit, that indicates the direction of carriage travel during the most recent black print pass. For example, it may be a hardware flip-flop or a dedicated hardware status bit in the microprocessor programmed to control the printer. Or it may be an assigned bit in a known location in memory connected with the printer's controller. It is important to carrying out the invention only that the indicia be accessible to the printer's controller during the analyzing step described above concerning the predetermination, i.e. during the printing of the color raster or at the end of the color raster printing, whether the to-be-printed black raster data is printable during a return pass of the printer's carriage. Any suitable indicia and means for storing and interrogating them to make such predetermination is within the spirit and scope of the invention.

The invented method now may be understood to represent a significant improvement to ink-jet printing methods whereby color and black ink printing selectively can be performed during passage of the printer's carriage, which carriage may mount both a color and a black pen. The improvement may be described as involving first printing a color swath with the carriage moving in a first direction, e.g. left to right, and second printing a to-be-printed black swath in a second direction that is the reverse of such first direction, e.g. right to left. Preferably the first printing is performed during a first pass of the printer's carriage and the second printing is performed during a return pass thereof that next and preferably immediately follows the first pass.

In accordance with the invented improvement, preferably before the first printing step it is determined whether a most recent black swath printing was performed in such reverse direction, and the second, reverse-carriage direction printing step is performed selectively, dependent upon the outcome of such determining step. Such selective second printing preferably is performed only if the most recent black swath-printing was also performed in such reverse direction. This selective second printing, during what conventionally was a non-printing color pass retrace period of time that resulted in substantial wasted time and motion, results in substantially increased printer throughput by rendering print-productive, albeit selectively, what heretofore was non-printing carriage motion.

Also in accordance with the invented improvement, preferably before such second printing step, it is determined whether the most recent black swath printing and the to-be-printed black swath meet predefined black dot relative position criteria, and the second printing step is performed selectively dependent upon such determining step. Preferably such criteria include black dot relative horizontal position criteria and black dot relative vertical proximity criteria. Also preferably such criteria include black dot relative horizontal alignment and relative vertical adjacency criteria, wherein such vertical adjacency criteria include continuity criteria.

All such black dot relative position criteria are as described above in reference to the invented method.

The improvement preferably further includes determining whether a most recent black swath printing was performed in the reverse direction and, if not, then further determining whether the most recent black swath printing and the to-be-printed black swath meet predefined black dot relative position criteria. In this way, black printing during color print retrace selectively is performed depending on the outcome of two sequential determinations, a first involving last black swath print carriage direction and a second involving present and most recent black swath dot relative position criteria. Those skilled in the art will appreciate that, with page buffering by the printer's controller, it is possible in many cases to optimize bidirectional, interleaved black and color swath printing by ensuring that the majority of consecutive black passes are suitable for printing during color pass carriage return. Such would be achieved by controlling the direction of the first in a relatively long series of black passes such that each in the series can be performed during color retrace.

Industrial Applicability

It may be seen then that the invented method substantially increases printer throughput when carriage-mounted black and color pens are used in a printed document. In printing black dots by the black pen, and then only to the extent possible without adversely affecting print quality, the return passage of the printer's carriage in printing color dots by the tri-color pen is used. Use of color pass return or retrace of the carriage to print black is avoided where such might result in visible black dot horizontal misalignment, e.g. when printing vertical black lines or patterns. In this way, printer throughput is substantially increased, as many non-printing returns of the printhead carriage are eliminated, and high black and color print quality is maintained. The invented method straightforwardly is implemented in firmware, relatively simply and at relatively low cost.

While the present invention has been shown and described with reference to the foregoing operational principles and preferred method, it will be apparent to those skilled in the art that other changes in form and detail may be made therein without departing from the spirit and scope of the invention as defined in the appended claims.

We claim:

1. In an ink-jet printing method whereby color and black ink printing are performed during passage of an ink-jet printer's carriage which mounts a color and a black pen, wherein a most recent black-only swath printing is a previously printed black-only swath that was printed most recently in time and a to-be-printed black-only swath is a black-only swath that has not been printed but awaits immediate printing, the improved method performed by the printer's controller comprising the steps of:

first printing a color-only swath with the carriage moving in a first direction;

determining whether the most recent black-only swath printing and the to-be-printed black-only swath meet predefined black dot relative position criteria; and if the most recent black-only swath printing and the to-be-printed black-only swath meet predefined black dot relative position criteria, then second printing the to-be-printed black-only swath in a second direction that is the reverse of said first direction.

2. The improved method of claim 1, wherein said selective second printing is performed only if the most recent black swath printing was performed in said reverse direction.

3. The improved method of claim 1, wherein said criteria include black dot relative horizontal position criteria and black dot relative vertical proximity criteria.

4. The improved method of claim 1, wherein said criteria include black dot relative horizontal alignment and relative vertical adjacency criteria.

5. The improved method of claim 4, wherein said vertical adjacency criteria include continuity criteria.

6. In an ink-jet printing method whereby color and black printing are performed during passage of an ink-jet printer's carriage which mounts a color and a black pen, wherein a most recent black swath printing is an immediately previously printed black swath and a to-be-printed black swath is a black swath that awaits immediate printing, the improved method performed by the printer's controller comprising the steps of:

first printing a color swath with the carriage moving in a first direction;

first determining whether the most recent black swath printing was performed in a second direction that is the reverse of said first direction; and second printing the to-be-printed black swath in said second direction if the most recent black swath printing was performed in said second direction.

7. The improved method of claim 6 which further comprises the steps of:

second determining whether the most recent black swath printing and the to-be-printed black swath meet predefined black dot relative position criteria if the most recent black swath printing was not performed in said reverse direction, and third printing the to-be-printed black swath in said second direction if the most recent black swath printing and the to-be-printed black swath meet predefined black dot relative position criteria.

8. An ink-jet printing method for color and black ink printing by an ink-jet printer having a controller and a printhead carriage that mounts a color and a black pen, the method comprising the steps of:

printing black raster data and storing an indicium of a first black direction of carriage movement during said printing;

printing color raster data with the carriage moving in a first color direction;

analyzing to-be-printed black raster data by the controller to predetermine whether the to-be-printed black raster data are printable during a return pass of the carriage in a direction opposite of said first color direction, with said predetermination being based at least in part upon said stored indicium; and if the to-be-printed black raster data are printable in said opposite direction then printing the to-be-printed black raster data during said return pass in the first black direction.

9. The method of claim 8, wherein said analyzing includes determining whether the first printed black raster data and the to-be-printed black raster data meet predefined black dot relative position criteria.

10. The method of claim 9, wherein said criteria include black dot relative horizontal position criteria and black dot relative vertical proximity criteria.

11. The method of claim 9, wherein said criteria include black dot relative horizontal alignment criteria and relative vertical adjacency criteria.

12. The method of claim 11, wherein said vertical adjacency criteria include continuity criteria.

* * * * *